US005423141A

United States Patent [19]

Myles et al.

[11] Patent Number: 5,423,141

[45] Date of Patent: Jun. 13, 1995

[54] SKI TICKET WICKET

[76] Inventors: John C. Myles; Melisa Syracusa, both of 107 Market St.; Edward M. Friedlander, Jr., 95 Market St., all of Portsmouth, N.H. 03801

[21] Appl. No.: 33,835

[22] Filed: Mar. 19, 1993

[51] Int. Cl.[6] ..... G09F 21/02; G09F 3/10

[52] U.S. Cl. ..... 40/586; 40/638

[58] Field of Search ..... 40/586, 594, 638, 663

[56] References Cited

U.S. PATENT DOCUMENTS

| | | | |
|---|---|---|---|
| 1,276,244 | 8/1918 | Mench | 40/663 |
| 1,458,444 | 6/1923 | Scott | 40/663 |
| 3,662,480 | 5/1972 | Gilson et al. | 40/586 X |
| 3,829,995 | 8/1974 | Fakoury | 40/586 X |
| 4,862,617 | 9/1989 | Cooke | 40/663 |

FOREIGN PATENT DOCUMENTS

| | | | |
|---|---|---|---|
| 2629936 | 10/1989 | France | 40/638 |
| 2105894 | 3/1983 | United Kingdom | 40/638 |

*Primary Examiner*—Edward K. Look
*Assistant Examiner*—Hoang Nguyen
*Attorney, Agent, or Firm*—William Nitkin

[57] ABSTRACT

A wicket for receipt therearound of a self-adhesive-backed ticket, such wicket attachable to an attachment member on an article of clothing of a user, such wicket having a planar body with an upper indicia receipt area and a lower ticket receipt area with structure for engagement with the attachment member and the planar body and locking structure to retain the wicket on the attachment member.

9 Claims, 3 Drawing Sheets

SKI TICKET WICKET

BACKGROUND OF THE INVENTION

2. Field of the Invention

The device of this invention resides in the area of ski ticket wickets and more particularly relates to a ski ticket wicket having integrally formed, interlocking means, such wicket providing portions thereof for placement of a ski ticket and for tile display of commercial advertisements.

2. Description of tile Prior Art

Ski ticket wickets of the prior art are comprised of bent metal wire members, a part of which is passed through, for example, an aperture in a zipper-pull of clothing worn by a skier. A ski ticket having a backing of self-adhesive material is then adhered to both sides of such ski ticket wicket by first adhering it to one side of the wicket, and the remaining portion of the ticket is folded around to tile other side of the wicket, thereby adhering it to both the wicket and to the back of tile ticket itself, sandwiching the wicket such that tile wicket is effectively locked onto the zipper-pull or other loop member of the skier's clothing. As a result, the wicket with ski ticket affixed thereto cannot be removed without tile ticket being torn or damaged or the wicket being damaged. This feature prevents the ticket, which represents payment for one day's use of a ski lift, from being easily transferred to, and used by, another skier so that each skier wishing to use the ski lift must purchase his or her own ticket.

Wire wickets that are commonly used merely provide means for displaying a purchased ticket which is adhered therearound and they have no planar portions of any kind for the display of other indicia since they consist of only a bent piece of wire.

SUMMARY OF THE INVENTION

It is an object of this invention to provide an improved ski ticket wicket which is easily and inexpensively manufactured, being made of plastic or other material manufactured from a planar sheet of such material by processes including, but not limited to, die-cutting.

It is a further object of this invention to provide a ski ticket wicket having an area on the wicket itself for the placement of indicia such as advertising and/or promotional, material on the front and/or rear of the wicket. The advertising, such as a company trademark, can be placed by either the ski facility or paid for by other advertisers and in the latter case would generate additional revenue from the use of the wicket of this invention to benefit the skiing facility and/or others producing or selling the wicket of this invention. A ski ticket wicket that provides space thereon for advertising stimulates commerce and provides economic advantages over wire wickets of the prior art which have no means for displaying any kind of indicia or advertising thereon because of their narrow wire structure and the fact that very little protrudes beyond the ticket itself other than an attachment wire.

The nature of ski tickets is well known in the art. Such tickets frequently will have bar code indicia thereon which can be quickly read by bar code scanners. Many tickets that are currently utilized are rectangular in shape with self-adhesive material on their backs. These tickets are folded around the prior art bent wire wickets and adhere to the wickets and to themselves in open areas where there is no wire. The wicket of this invention also provides for open areas in its planar structure which allows a self-adhesive-backed ticket to be placed therearound and to be adhered to the wicket and to itself both around the sides of the wicket and through such open areas. The planar body member of the wicket of this invention has an integrally formed insert member which can pass through a loop member on the user's clothing or through the aperture in a zipper-pull and which insert member can then be fitted into a mating receipt area in the wicket also formed in the manufacturing process so that once the self-adhesive ticket is folded and adhered therearound, the wicket cannot be removed from the loop member to which it is attached unless either the ticket is damaged or destroyed or the wicket is cut off.

DESCRIPTION OF THE PREFERRED EMBODIMENT(S)

Figure 1:
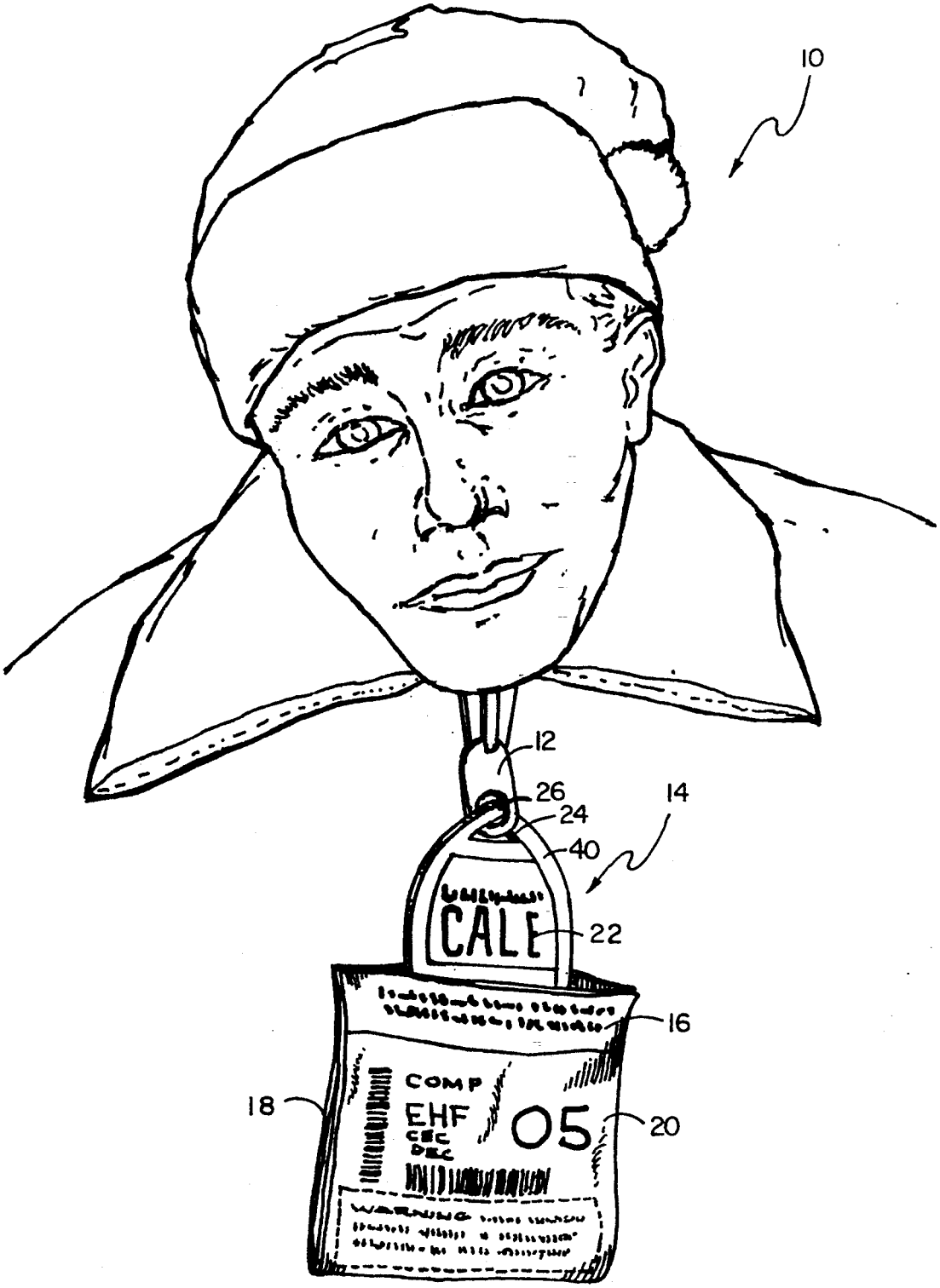
FIG. 1 illustrates a perspective view of the wicket of this invention with a ticket affixed thereon showing one embodiment of the attachment receipt member.
Figure 2:
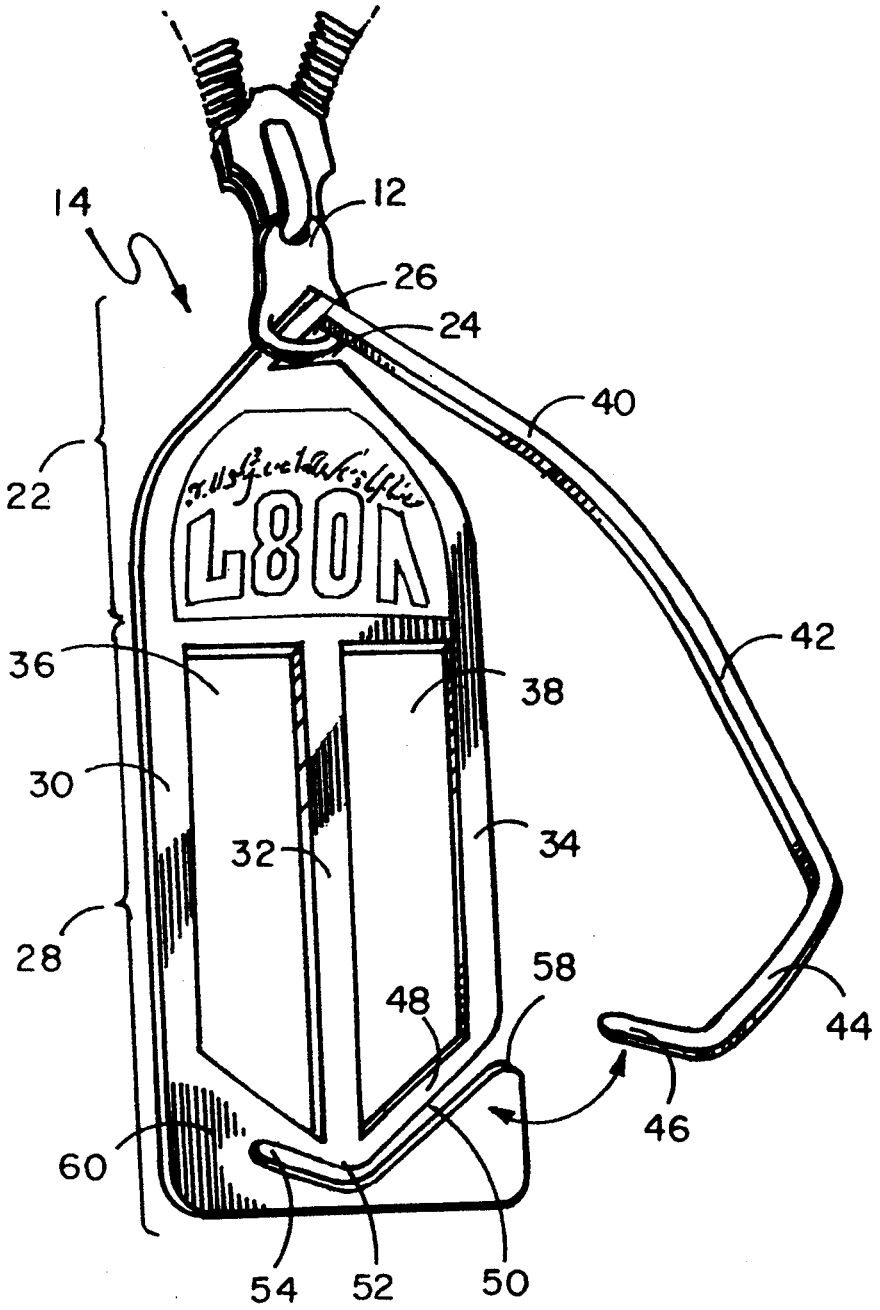
FIG. 2 illustrates a perspective view of the wicket of FIG. 1 in its open mode with its insert member having been passed through a zipper-pull aperture.

FIG. 1 illustrates a skier 10 wearing a ski parka having a typical zipper-pull 12 which has a zipper-pull aperture 26 formed therein. To utilize wicket 14 of this invention, insert member 40 is drawn away from the planar body member and inserted through zipper-pull aperture 26. As illustrated in FIG. 2 the wicket has two portions, an upper portion 22 and lower portion 28. On upper portion 22 can be placed indicia such as an advertisement and/or promotional material, such as a company trademark, and on lower portion 28 is placed the ski ticket. Ticket 16, as illustrated in FIG. 1, is typically rectangular in shape and has a self-adhesive backing which ticket, after its paper adhesive covering sheet on its back has been removed, is then folded around lower portion 28 and its back is adhered to both sides of lower portion 28 of wicket 14. Ticket 16 has its rear portion 18 disposed and attached on the rear side of the wicket and its front portion 20 attached on the front side of the wicket. Ski ticket 16 can have any indicia printed thereon and can include bar code indicia. Often in the prior art metal wire wickets are not removed from their initial attachment to a skier's clothing, and a new ticket for a new day of ski lift use is placed over an old ticket. Similarly, when using the wicket of this invention, a new ticket can be adhered over an old ticket, allowing the skier to use a ski facility's ski lift for a new day of skiing.

Figure 3:
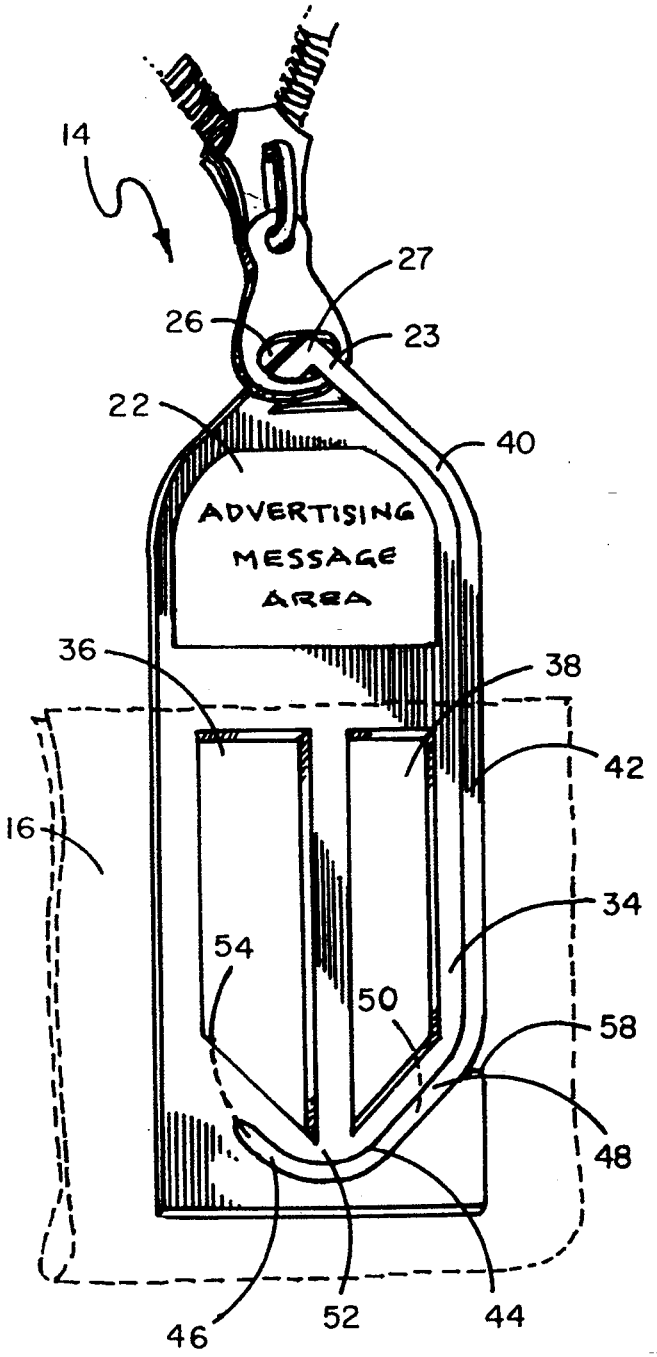
FIG. 3 illustrates a perspective view of the wicket of FIG. 1 in its closed mode, with its insert member having been passed through a zipper-pull aperture with the insert member then fixed in a mating receipt area within the planar body of the wicket with the ticket shown in outline form attached thereover, locking the wicket in place to the zipper-pull.

FIG. 2 illustrates the structure of wicket 14 of this invention in its open mode with generally vertically disposed insert member 40 separated from the planar body with no ticket adhered thereon. FIG. 2 shows the wicket as being formed from a unitary planar member. Upper portion 22 is seen with advertising indicia thereon, but it should be understood that any indicia or advertising message can be placed thereon. The ski ticket, as shown in outline form in FIG. 3, is adhered to lower portion 28 of the wicket. Left side member 30, right side member 34 and central member 32 each extend downward from upper portion 22 to base member 60. Left side aperture 36 is formed between left side member 30 and central member 32, and right side aperture 38 is formed between central member 32 and right side member 34. When a ticket is adhered to the front and rear of wicket 14, it will adhere not only to the planar body member of the wicket, but also to itself around its edges and through apertures 36 and 38 as it is pressed against itself. Since the ticket adheres to itself along three sides of the wicket, the purpose of apertures 36 and 38 is to provide additional areas on the wicket itself where the self-adhesive backing of the ski ticket can adhere to itself. Although two apertures are illustrated in FIG. 2, one aperture or a plurality of apertures can be utilized or the planar body member where apertures 36 and 38 are located could even be solid. Rib member 48 connects the bottom of right side member 34 to shoulder member 52 formed at the bottom of central member 32. Within base member 60 is defined insert member receipt slot 50 which can extend inwardly and downwardly from the right side of the wicket, around shoulder 52 and then upwardly to form hook member receipt slot 54. Base member 60, as seen in FIG. 2, can be generally rectangular in shape at its bottom although base member 60 can have other shapes. Formed integrally as part of the wicket is insert member 40, and its mating insert member receipt slot 50 and hook member receipt slot 54 together form a V-shaped slot. Insert member 40 is seen passed through zipper-pull aperture 26. The lower portion of the zipper-pull is positioned in receipt aperture 24 defined at the top of the wicket.

When the wicket of this invention is utilized, hook portion 46 of insert member 40 is pulled away from the body of the wicket in a first mode and the tip of hook portion 46 is passed through an attachment member having an opening of the user's clothing such as zipper-pull aperture 26, and zipper-pull 12 is advanced up insert member 40 until it reaches and passes into receipt aperture 24 of attachment receipt member 27 located at the top of the wicket. In a preferred embodiment the tip of hook portion 46 can be somewhat pointed to facilitate insertion into the opening of the attachment member. Insert member 40 forms the right side 23 of attachment receipt member 27 and the left side is formed as part of the planar body of the wicket. Receipt aperture 24, as seen in FIGS. 1–3, is triangular in shape but can also be of other shapes such as circular as described further below. Next the inwardly extending portion 44 of insert member 40 is inserted into mating insert member receipt slot 50, and hook portion 46 of insert member 40 is likewise received at the same time into the adjoining mating hook member receipt slot 54. Once in it closed second mode position, insert member 40 is aligned along the right side of right side member 34 of lower portion 28 of the wicket. Right side member 34 is disposed inward of right side 58 of base member 60 a distance equivalent to the front width of insert member lower portion 42 such that when inwardly extending portion 44 of insert member 40 is engaged into its mating insert member receipt slot 50, right side 50 of base member 60 is aligned with the outermost side of lower portion 42 of the insert member. Once fitted into place in its closed mode, insert member 40 of the wicket cannot be laterally pulled out of insert member receipt slot 50 because right side 58 of the base member blocks lateral movement to the right. Other design features of the wicket also prevent lateral movement of insert member 40 once the wicket is in its closed mode and before a ticket is adhered to the wicket. Hook portion 46 of insert member 40, when placed within hook member receipt slot 54, is prevented from lateral movement by shoulder member 52. The engagement of insert member 40 in insert member receipt slot 50 also prevents vertical movement of the insert member so that it cannot be pulled upwards out of ticket 16. The only way to disengage the insert member before a ticket is affixed to the wicket is to push it out either frontwardly or rearwardly from insert member receipt slot 50 as the material of the insert member 40 is flexible. Once ticket 16 is adhered to the front and back of the wicket and to itself as seen in FIG. 3, covering lower portion 28 of the wicket, insert member 40 is effectively prevented from any forward, rearward, upward or downward movement out of insert receipt slot 50 and hook member receipt slot 54. FIG. 3 illustrates ticket 16 adhered in place around wicket 14 in its closed mode. Inwardly extending portion 44 of insert member 40 is shown positioned within insert member receipt slot 50, and hook portion 46 of insert member 40 is positioned within hook member receipt slot 54 extending around shoulder 52. The wicket of this invention with ticket adhered thereto cannot be removed for use by another since the ticket would be torn or damaged in the process due to the strong self-adhesive backing on the ticket or the wicket would be damaged. Thus the ticket cannot be peeled apart and separated from the wicket to allow the insert member to be extracted from the zipper-pull aperture or other clothing loop or aperture in the attachment member.

Figure 4:
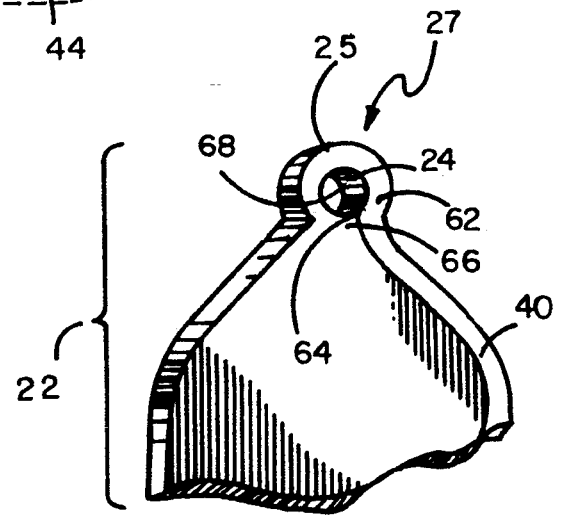
FIG. 4 illustrates a perspective view of an alternate embodiment of the attachment receipt member of the wicket of this invention.

FIG. 4 illustrates an alternate embodiment of attachment receipt member 27, the top of which is circular in configuration. Insert member 40 forms the right side of the structure of circular member 25 which has circular receipt aperture 24 defined therein. As insert member 40 is formed as part of circular member 25, it forms an inward curve 66 extending to a curved side 62 of circular member 25, forming an openable slit 64 defined between the insert member and upper portion 22 of the wicket's body, such slit extending into receipt aperture 24. Slit 64 is disposed at a tangent to circular receipt aperture 24. Lip 68 is formed in a side of the planar body around circular receipt aperture 24 where slit 64 enters circular receipt aperture 24. Lip 68 helps to securely retain the attachment member within the receipt aperture. When insert member 40 is passed through the attachment member which is then passed into the receipt aperture, unlike the version illustrated in FIGS. 1–3 where the attachment member if forced could directly move out of the receipt aperture along the insert member, in the embodiment of FIG. 4 movement of the insert member is blocked by lip 68 which acts to trap the attachment member in the receipt aperture.

Indicia, such as an advertisement, on upper portion 22 of the wicket can be placed on both the front and rear sides of the wicket and any desired indicia can be placed thereon. The ski ticket wicket of this invention can provide an additional source of revenues to ski facilities and provide advertisers with new means to target the skiing public. The wicket of this invention can also be used for non-ski ticket purposes such as when tickets are worn by patrons of other types of establishments such as amusement parks and the like.

Although the wicket of this invention has been illustrated attached to a zipper-pull aperture, as noted above, the wicket can also be attached to any permanent loop forming an attachment means of a skier's clothing which attachment would prevent its easy removal and unauthorized transfer to another individual.

Wicket 14 can be manufactured from high or low-density polyethylene or other type of plastic or equivalent material that will have the strength to accomplish the structural goals of the wicket as described herein. Other flexible, sturdy material capable of being fabricated in this manner can also be utilized.

Although the present invention has been described with reference to particular embodiments, it will be apparent to those skilled in the art that variations and modifications can be substituted therefor without departing from the principles and spirit of the invention.

We claim:

1. A wicket for receipt of a self-adhesive-backed ticket, said wicket to be attached to an attachment member on an article of clothing of a user, said attachment member having an opening defined therein, comprising:

a planar body having a front side, a rear side, an upper portion with a top, and a lower portion, said planar body having an attachment receipt member having a receipt aperture defined therein, said attachment receipt member positioned at the top of said planar body;

means for engagement of said attachment member with said attachment receipt member;

an indicia receipt area disposed on at least one side of said planar body, said indicia receipt area disposed in said upper portion of said planar body;

a ticket receipt area defined in said lower portion of said planar body, said lower portion adapted for receipt therearound of said self-adhesive-backed ticket;

wherein said means for engagement comprise a generally vertically disposed insert member having an upper portion and a lower portion having an end, said insert member at its top forming a portion of said attachment receipt member, said insert member in a first open mode being pulled away from said planar body, opening said receipt aperture in said attachment receipt member with said insert member's end passing through said opening in said attachment member, said insert member integrally formed with, and in planar alignment with, said planar body to allow said attachment member to be passed up said insert member into the receipt aperture of said attachment receipt member, said insert member in its second closed mode being positioned adjacent to said planar body, closing said attachment receipt member around said attachment member.

2. The wicket of claim 1 further including means to position the lower portion of said insert member in mating relationship with said planar body.

3. The wicket of claim 2 wherein said planar body further includes an insert member receipt slot defined therein to receive said insert member therein in a mating relationship.

4. The wicket of claim 3 wherein said insert member receipt slot is V-shaped and said insert member includes an upwardly extending hook member at the end thereof such that said insert member and hook member can be positioned in mating relationship within said insert member receipt slot.

5. The wicket of claim 4 wherein when said insert member is engaged in said insert member receipt slot of said planar body it is retained in said mating relationship with said planar body by said self-adhesive backed ticket.

6. The wicket of claim 5 wherein the lower portion of said planar body includes:

a right member, a left member and a central member, each of said members extending downward from said upper portion of said planar body;

a rib member interconnecting said right member and said central member; and a base member attached to said left member, said V-shaped insert member receipt slot defined between said base member and said rib member for receipt of said insert member.

7. The wicket of claim 6 wherein said attachment receipt member further includes means to lock said attachment member within the receipt aperture in said attachment receipt member.

8. The wicket of claim 7 wherein said locking means includes:

a circular aperture defined in said attachment receipt member; and wherein said insert member forms a side of said attachment receipt member, said insert member defining a slit disposed tangentially to said circular receipt aperture, said slit communicating with said circular receipt aperture when said insert member is in its first open mode and forming a lip in said planar body which lip blocks said attachment member from being easily removed from said circular receipt aperture of said attachment receipt member when said insert member is in its second closed mode.

9. The wicket of claim 5 wherein said planar member is of unitary construction.

* * * * *